US011408697B2

(12) United States Patent
Szczepkowski et al.

(10) Patent No.: US 11,408,697 B2
(45) Date of Patent: Aug. 9, 2022

(54) FIREARM MAGAZINE EXTENSION ARTICLE

(71) Applicant: XTech Tactical, LLC, Tempe, AZ (US)

(72) Inventors: Michael Przemyslaw Szczepkowski, Mesa, AZ (US); David Joel Spykerman, Chandler, AZ (US)

(73) Assignee: XTECH TACTICAL, LLC, Tempe, AZ (US)

( * ) Notice: Subject to any disclaimer, the term of this patent is extended or adjusted under 35 U.S.C. 154(b) by 0 days.

(21) Appl. No.: 15/589,987

(22) Filed: May 8, 2017

(65) Prior Publication Data

US 2017/0321979 A1 Nov. 9, 2017

Related U.S. Application Data

(60) Provisional application No. 62/332,823, filed on May 6, 2016.

(51) Int. Cl.
*F41A 9/71* (2006.01)

(52) U.S. Cl.
CPC ..... *F41A 9/71* (2013.01)

(58) Field of Classification Search
CPC ..... F41A 9/61; F41A 9/65; F41A 9/71
USPC ..... 42/49.02, 50; 89/197
See application file for complete search history.

(56) References Cited

U.S. PATENT DOCUMENTS 4,343,107 A * 8/1982 Kaltenegger ..... F41A 9/65 42/7
4,397,109 A * 8/1983 Pachmayr ..... F41A 9/65 42/50
4,495,720 A * 1/1985 Bross ..... F41A 9/65 42/7
4,514,922 A * 5/1985 Farrar ..... F41A 9/67 42/50
4,592,160 A * 6/1986 Bross ..... F41A 9/65 42/7
4,862,619 A * 9/1989 Baldus ..... F41A 9/71 42/7
5,081,778 A * 1/1992 Switzer ..... F41A 9/66 42/50
5,438,783 A * 8/1995 Sniezak ..... F41A 9/65 42/50
5,526,600 A * 6/1996 Chesnut ..... F41A 9/65 42/50
5,584,136 A * 12/1996 Boland ..... F41A 9/71 42/50

(Continued)

*Primary Examiner* — Joshua E Freeman
*Assistant Examiner* — Benjamin S Gomberg
(74) *Attorney, Agent, or Firm* — Klintworth & Rozenblat IP LLP

(57) ABSTRACT

A firearm magazine extension article generally comprises; an extension spring stop that couples to a distal end of an OEM firearm magazine, and an extension body that couples to the extension spring stop. The extension body further comprises locking tabs receivable by the extension spring stop to secure it and the whole of the article to the OEM firearm magazine. To deter any lateral movement by the article and to further secure the article, the extension spring stop comprises a first spring plate receiving orifice to receive a spring plate tab, and the extension body comprises a second spring plate receiving orifice to also receive the spring plate tab.

11 Claims, 3 Drawing Sheets

(56) References Cited

U.S. PATENT DOCUMENTS

| | | | | |
|---|---|---|---|---|
| 5,666,752 | A * | 9/1997 | Grams | F41A 9/71 42/49.02 |
| 6,557,287 | B2 * | 5/2003 | Wollmann | F41A 9/65 42/50 |
| 6,568,115 | B2 * | 5/2003 | Beretta | F41A 9/65 42/50 |
| 7,117,622 | B2 * | 10/2006 | Freed | F41A 9/65 42/7 |
| 7,200,963 | B1 * | 4/2007 | Vieweg | F41A 9/65 42/49.01 |
| 8,863,423 | B2 * | 10/2014 | Clifton, Jr | F41A 9/65 42/50 |
| 8,925,231 | B2 * | 1/2015 | Lee | F41A 9/65 42/49.01 |
| 9,772,151 | B1 * | 9/2017 | Sanderson | F41A 9/64 |
| 9,784,513 | B2 * | 10/2017 | Zimmer | F41A 9/70 |
| 2015/0096214 | A1 * | 4/2015 | Jones, III | F41A 9/71 42/49.01 |

* cited by examiner

FIREARM MAGAZINE EXTENSION ARTICLE

CROSS-REFERENCE TO RELATED APPLICATIONS

This disclosure claims priority to U.S. provisional patent application 62/332,823 filed May 6, 2016; the entire contents of which are hereby incorporated by reference.

BACKGROUND OF THE INVENTION

Firearms, such as handguns, automatic rifles, and the like, are equipped with firearm magazines that hold a fixed number of rounds of ammunition. As the firearm is discharged, the magazine provides subsequent ammunition delivered into the chamber of the firearm for repeated shooting until the magazine is depleted of ammunition. Once depleted, the magazine must be removed from the firearm and re-filled with ammunition or replaced with another magazine that contains ammunition.

Often, the magazine of a firearm provides for a limited number of rounds of ammunition that is less then what the user of the firearm desires. As such, firearm aftermarket providers have developed firearm magazine extenders that couple to the magazine and allow for a greater number of ammunition rounds to be stored and used. However, these extenders are often difficult to couple to the Original Equipment Manufacturers (OEM) magazine. Moreover, they are often unreliable, not durable, aesthetically unappealing, etc.

What is needed is a firearm magazine extension article that overcomes the above noted downsides to the current state of the art and disadvantages, and which is disclosed by the present firearm magazine extension article.

SUMMARY OF THE INVENTION

Among various representative embodiments, a firearm magazine extension article generally comprises an extension spring stop that couples to a distal end of an OEM firearm magazine. The article also comprises an extension body that couples to the extension spring stop. The extension body further comprises locking tabs receivable by the extension spring stop to secure it and the whole of the article to the OEM firearm magazine. To deter any lateral movement by the article and to further secure the article, the extension spring stop comprises a first spring plate receiving orifice to receive a spring plate tab, and the extension body comprises a second spring plate receiving orifice to also receive the spring plate tab.

BRIEF DESCRIPTION OF THE DRAWINGS

A more complete understanding of a firearm magazine extension article may be derived by referring to the detailed description and claims when considered in connection with the following illustrative FIGS. In the following FIGS., like reference numbers refer to similar elements and/or steps throughout the FIGS.

The various exemplary embodiments and elements in the FIGS. are illustrated for simplicity and clarity, and have not necessarily been rendered according to any particular assembly or sequence. For example, article assemblies may be performed sequentially, concurrently or in any of a variety of orders.

DETAILED DESCRIPTION OF THE INVENTION

A firearm magazine extension article may be described herein in terms of a variety of elements, systems or functional block components and/or various method or processing steps. Such elements, systems or functional blocks may be realized by any number of hardware components that perform specified functions and that may achieve various results. For example, the firearm magazine extension article may employ various magazine spring stops, magazine extension bodies, securing mechanisms, having any number and variety of magazine coupling configurations, ammunition feeding and storage configurations, spring stop mechanisms and the like, as well as any of a variety of aesthetic designs, and the like, which may carry out a variety of functions to operate as a firearm magazine extension article. In addition, the firearm magazine extension article may be practiced in conjunction with any number of firearm environments and may be customizable for a particular firearm use, be it for sport, hunting, military, law enforcement, etc. And the firearm magazine extension articles that are described are merely exemplary embodiments and applications of use with a handgun, automatic rifle, and any other like firearms that may benefit from an extendable firearm magazine. Further, the firearm magazine extension article may employ any number of conventional techniques for manufacturing, packaging, marketing, selling, distributing, and the like.

Figure 1:
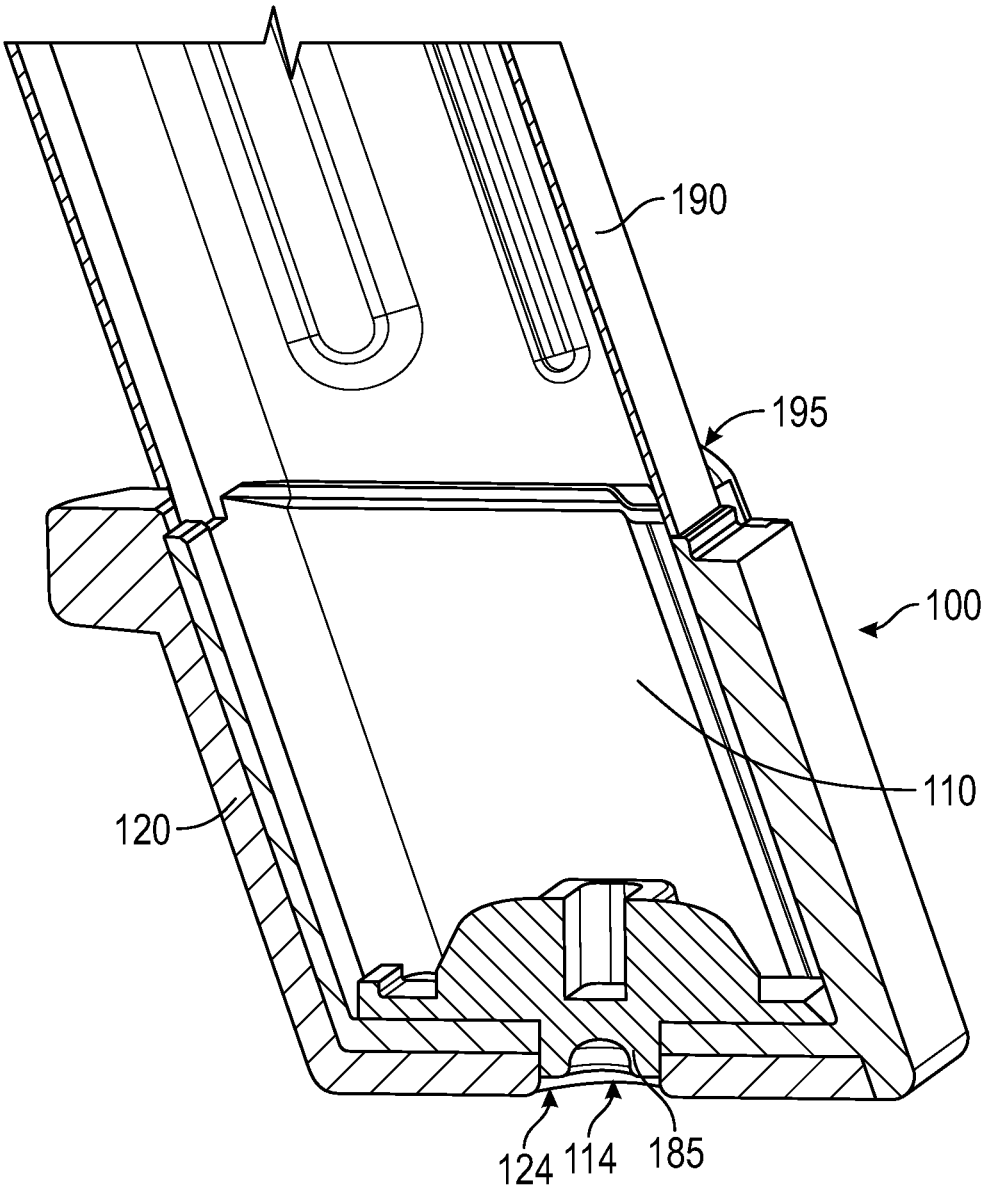
FIG. 1 representatively illustrates an exemplary embodiment of cross-section of a firearm magazine extension article.

Various representative embodiments of a firearm magazine extension article may be applied to an article for extending a firearm magazine to accommodate a greater number of rounds of ammunition, greater than that provided by the firearm's Original Equipment Manufacturer ("OEM") magazine. Referring now to FIG. 1, a cross-section of an exemplary embodiment of a firearm magazine extension article 100 comprises an extension spring stop 110 that couples to a distal end 195 of an OEM firearm magazine 190. Article 100 also comprises an extension body 120 that couples to extension spring stop 110 that operates to secure extension spring stop 110 to OEM firearm magazine 190. Extension body 120 further comprises locking tabs 222 (FIG. 2) receivable by extension spring stop 110 to further secure and/or lock article 100 to OEM firearm magazine 190. Among various exemplary embodiments, a first spring plate receiving orifice 114 of extension spring stop 110 receives a spring plate tab 185. Article 100 also comprises extension body 120 to comprise a second spring plate receiving orifice 124 to also receive spring plate tab 185. Those skilled in the art will appreciate that an OEM spring plate tab may not comprise the requisite standoff, i.e. length, to extend through both first spring plate receive orifice 114 and second spring plate receiving orifice 124, as such, some exemplary embodiments may require an aftermarket spring plate that comprises a spring plate tab having sufficient length to extend through both of first spring plate receive orifice 114 and second spring plate receiving orifice 124.

Figure 2:
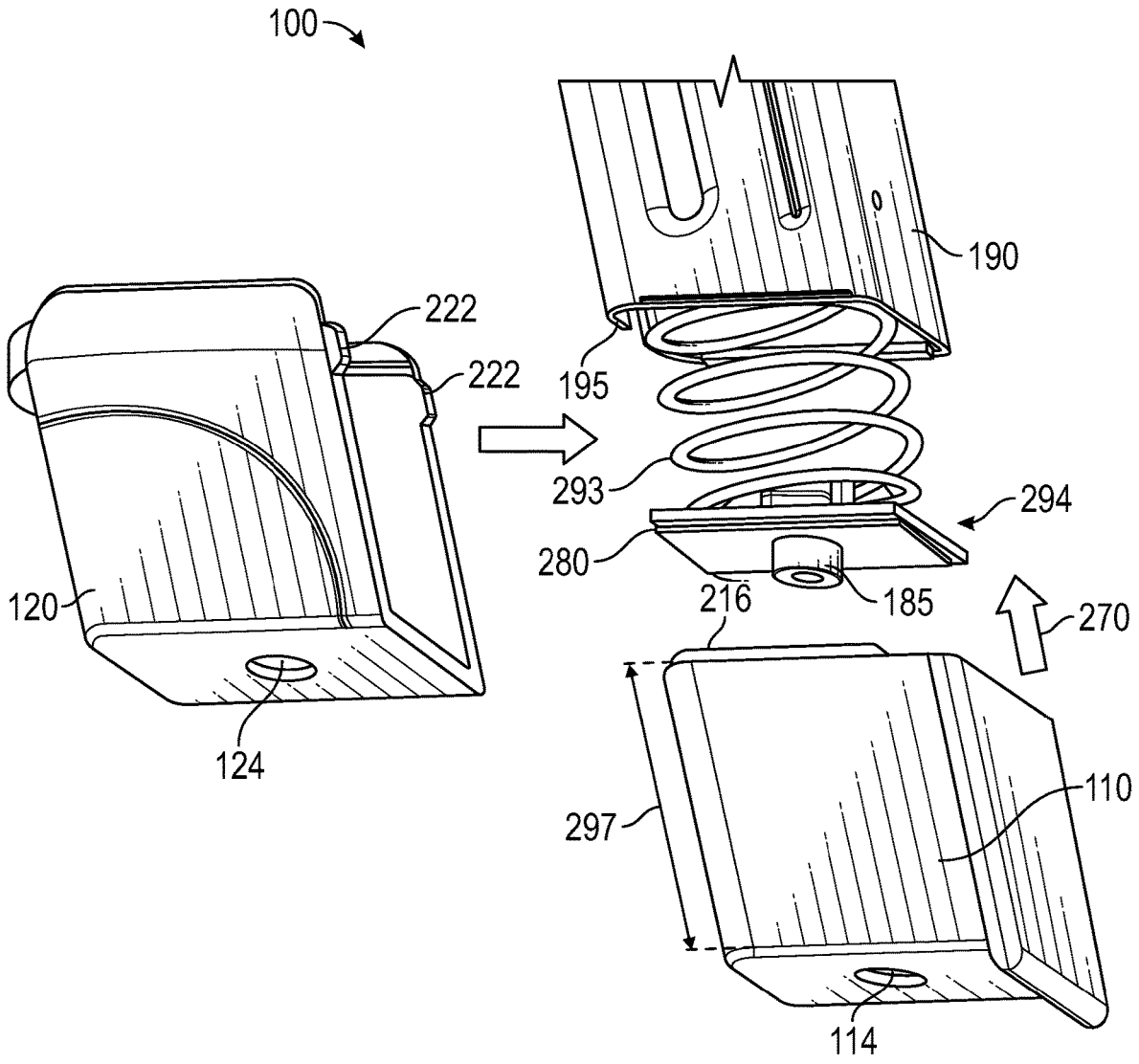
FIG. 2 pictorially demonstrates an exemplary assembly of an extension spring stop of the firearm magazine extension article coupling to an existing firearm magazine.

Turning now to FIG. 2, those skilled in the art will understand that in a preferred embodiment, article 100 comprises extension spring stop 110 that couples to distal end 195 of OEM magazine 190, which is exemplified by assembly directional arrow 270. As extension spring stop 110 couples to OEM firearm magazine 190, a magazine interface tab 216 aligns extension spring stop 110 to distal end 195 of OEM firearm magazine 190. Article 100 further comprises spring plate 280, which is a modified spring plate of OEM firearm magazine comprising spring plate tab 185, which is greater in length then the spring plate tab of the OEM spring plate. The longer spring plate tab allows the spring plate tab to extend not only through the first spring plate receive orifice 114, but also through the second spring plate receiving orifice 124.

As depicted by FIG. 2, a coupled internal spring 293 couples to an upper portion 294 of spring plate 280, and as such will be able to provide a force back through OEM firearm magazine 190. It will be further appreciated by those skilled in the art that as extension spring stop 110 couples to OEM magazine 190, spring plate tab 185 nests within first spring plate receiving orifice 114, which deters any lateral movement of article 100 when coupled to OEM magazine 190. While a helical spring as shown is a preferred embodiment to provide the force back as described, those skilled in the art will appreciate that any other mechanism now known or developed in the future may be employed. For example, instead of internal spring 293 of helical configuration providing the force back, any other type of spring, piston, pneumatic, magnetic, motorized, mechanism may be employed.

Figure 3:
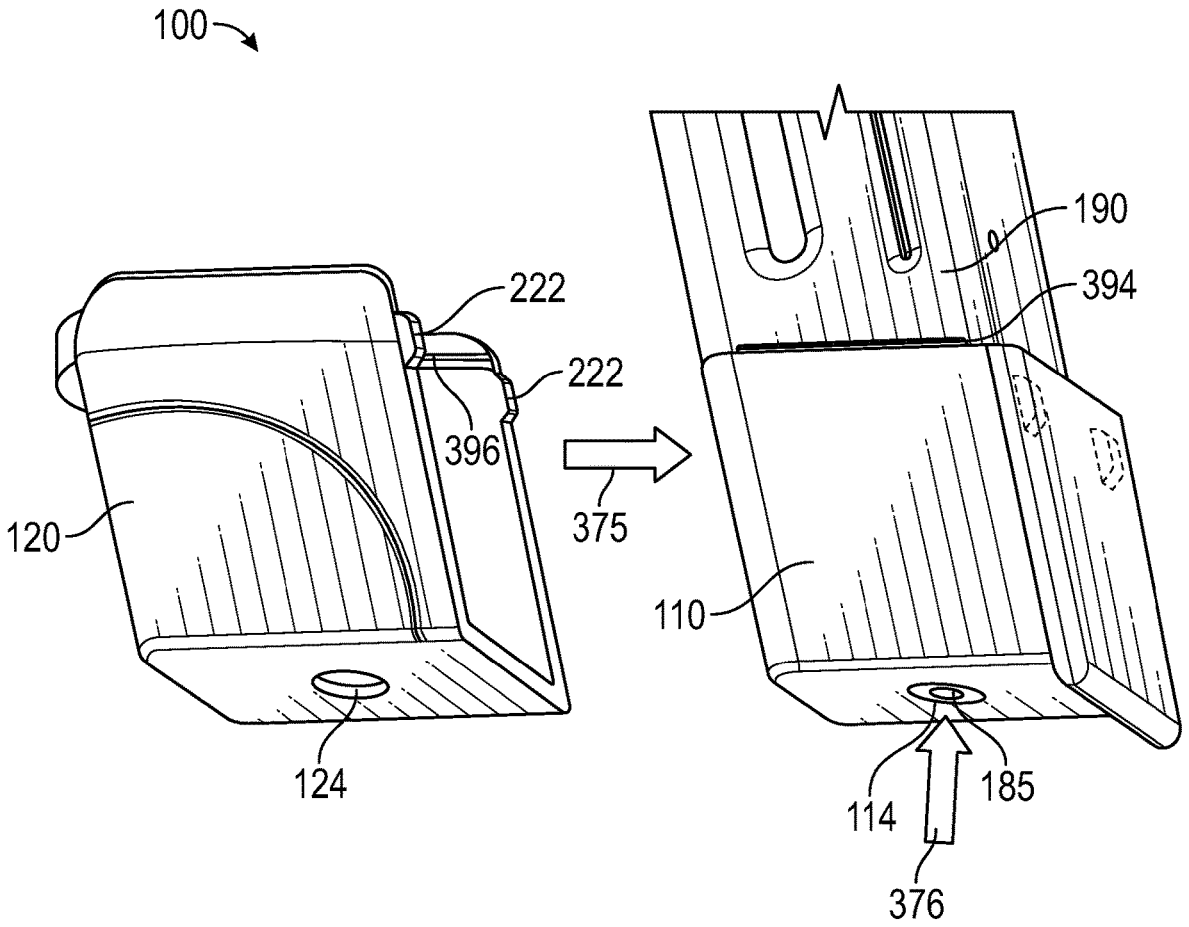
FIG. 3 pictorially demonstrates an exemplary assembly of an extension body of the firearm magazine extension article coupling to the extension spring stop and the existing firearm magazine to complete the firearm magazine extension.

Turning now to FIG. 3, those skilled in the art will understand that in a preferred embodiment, article 100 further comprises extension body 120 to couple to extension spring stop 110 (now mated to distal end 195 of OEM magazine 190) wherein extension body 120 couples to extension spring stop 110 as exemplified by assembly directional arrow 375. As extension body 120 couples to extension spring stop 110, extension body locking tabs 222 are received by extension spring stop 110 to secure extension body 120 to extension spring stop 110 to prevent extension body 120 from splaying open. Moreover, extension body 120, comprising extension body securing grooves 396 and they correspondingly mate with OEM magazine 190 via OEM magazine tabs 394. In this manner extension body 120 further secures extension spring stop 110 to OEM magazine 190 and deters disengagement from OEM firearm magazine 190. It will be further appreciated by those skilled in the art that as extension body 120 couples to extension spring stop 110, spring plate tab 185 (FIGS. 1 and 2) further nests within second spring plate receiving orifice 124, which further deters any lateral movement of article 100 when coupled to OEM magazine 190. As shown by FIG. 3 spring plate tab 185 is provided to further nest within second spring plate receiving orifice 124 by a user pushing up, via direction arrow 376, on spring plate tab 185 so that it is substantially flush with the underside of extension spring stop 110; sliding extension body 120 over extension spring stop 110 and locking extension body 120 to extension spring stop 110 by locking tabs 222. Once secured, the internal spring 293 forces spring plate tab 185, from the substantially flush position, downward so that spring plate tab 185 further engages second spring plate receiving orifice 124, thereby additionally securing extension spring stop 110 to OEM magazine 190 and extension body 120.

Those skilled in the art will understand the above disclosed and shown interconnectivity and locking of extension spring stop 110 and extension body 120 to provide for the firearm magazine extension article is a preferred embodiment and merely one manner in which such firearm magazine extending article may be rendered. It is within the ambit of this disclosure that those skilled in the art will understand that other configurations may be similarly employed to accomplish the goal of extending the OEM's firearm magazine. For example, a dimensionally different extension spring stop may be employed that is wider, narrower, or otherwise dimensionally configured apart from what is discussed and shown, may be used. Likewise, an alternate extension body to accommodate any other type of extension spring stop may be used, and such alternate extension body may couple to any alternately configured extension spring stop in any variety of other fashions, e.g. by screw, welds, glues, alternate locking tabs, magnets, etc. Moreover, instead of extension body coupling (nesting) to extension spring stop as shown via directional arrow 375 as shown, other coupling directions may be employed. In other words, the extension spring stop and the extension body may be coupled from a bottom, a front side, back side, alternate side, etc.

To install extension article 100 on an OEM magazine, such as OEM magazine 190 (FIGS. 1-3), a user first positions extension spring stop 110 in abutment with the lower end of magazine body 190 in the manner indicated by arrow 270 in FIG. 2. When extension spring stop 110 is so positioned, at least one magazine interface tab 216 of extension spring stop 110 is received into the lower or distal end of magazine 190 to align extension spring stop 110 to OEM firearm magazine 190. Spring plate 280 inserts into the open cavity of extension spring stop 110 and is pressed against the floor of spring stop 110 by spring 293, with spring plate tab 185 received through spring plate receiving orifice 114 provided in the lower wall of spring stop 110. Next, as indicated by arrow 376 in FIG. 3 the user depresses spring plate tab 185 upwardly (noting tab 185 is dimensioned to extend through orifice 114 and beyond spring stop 110 in a downward direction) to allow extension body 120 to slide into full engagement with magazine body 190 and spring stop 110, as indicated by arrow 375. As extension body 120 is slid into position, spring plate receiving orifices 114, 124 are brought into vertical alignment, with spring plate tab 185 received through orifices 114, 124 when aligned due to the spring force acting on spring plate 280. Extension body 120 and, more generally, article 100 attaches to magazine body 190 via reception of outwardly-projecting magazine tabs 394 into grooves 396 formed in opposing sidewalls of extension body 120 (identified in FIG. 3). Additionally, when extension body 120 is slid into its assembled position, locking tabs 222 are received into corresponding slots or openings provided in a wall of extension spring stop 110 (the rightmost wall or backwall of spring stop 110 in the drawing figures). Locking tabs 222 thus deter the outward splay or deflection of the sidewalls of extension body 120 to reduce the likelihood of disengagement of magazine tabs 394 from securing grooves 396 absent intentional disassembly of extension article 100. Extension article 100 is consequently assembled onto to OEM magazine 190 in a secure manner, with extension body 120 surrounding spring stop 110 on three sides and article 100 effectively increasing the round-carrying capacity of the resultant assembly. With reference to FIG. 2, dimension 297 of extension spring stop 110 is of a discrete length such that the interior body of extension spring stop 110 can accommodate a discrete number of additional ammunition pieces commensurate with the dimension 297. However, those skilled in the art will understand that extension spring stop 110 can comprise a dimension lesser or greater than discrete dimension 297 to respectively accommodate fewer or more ammunition pieces then would be accommodated by extension spring stop 110 comprising discrete dimension 297.

Those skilled in the art will understand that while exemplary embodiments of a firearm magazine extension article have been described, many other exemplary embodiments may comprise various other elements not specifically described yet known to those in the art. Furthermore, any of the exemplary embodiments described may include some, all, or none of the elements of the other exemplary embodiments described. Finally, while the spirit and scope of this disclosure has focused primarily on exemplary and preferred elemental components that comprise the firearm magazine extension article as contemplated within, this disclosure contemplates any variety of other components that may be consistent with a firearm magazine extension article.

In the foregoing specification, the firearm magazine extension article has been described with reference to various embodiments. Modifications and changes may be made, however, without departing from the scope of the firearm magazine extension article as set forth in the claims. The specification and FIGS. are illustrative, rather than restrictive, and any modifications are intended to be included within the firearm magazine extension article. Accordingly, the scope of the firearm magazine extension article should be determined by the claims and their legal equivalents rather than by merely the examples described.

For example, the components and/or elements recited in any apparatus, article, device, and the like claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes", "is" or any variation thereof, are intended to reference a non-exclusive inclusion, such that a process, method, article, composition, device, system or apparatus that comprises a list of elements does not include only those elements recited, but may also include other elements not expressly listed or inherent to such process, method, article, composition, device, system or apparatus. Other combinations and/or modifications of the above-described structures, arrangements, applications, proportions, elements, materials or components used in the practice of the firearm magazine extension article, in addition to those not specifically recited, may be varied or otherwise particularly adapted to specific environments, manufacturing specifications, design parameters or other operating requirements without departing from the general principles of the same.

The invention claimed is:

1. A firearm magazine extension article, comprising:

an extension spring stop that couples to a distal end of an original equipment manufacturer (OEM) firearm magazine having outwardly-projecting magazine tabs, the extension spring stop comprising a first spring plate receiving orifice to receive a spring plate comprising a spring plate tab at an underside of the spring plate; and an extension body that couples to the extension spring stop to secure the extension spring stop to the OEM firearm magazine, the extension body comprising:

securing grooves formed in sidewalls of the extension body and configured to receive the OEM magazine tabs when the extension body is slid into engagement with the extension spring stop and the distal end of the OEM firearm magazine to lock the firearm magazine extension article to the OEM firearm magazine;

a second spring plate receiving orifice aligning with the first spring plate receiving orifice and further receiving the spring plate tab therein when the firearm magazine extension article is assembled onto the distal end of the OEM firearm magazine; and locking tabs extending into the extension spring stop to deter the sidewalls of the extension body from splaying open when the firearm magazine extension article is assembled onto the distal end of the OEM firearm magazine.

2. The firearm magazine extension article of claim 1, wherein the extension spring stop and the extension body are configured to increase a round-carrying capacity of the OEM firearm magazine when the firearm magazine extension article is assembled onto the distal end of the OEM firearm magazine.

3. The firearm magazine extension article of claim 1, wherein the extension spring stop abuts the distal end of the OEM firearm magazine adjacent the OEM magazine tabs when the firearm magazine extension article is assembled onto the distal end of the OEM firearm magazine.

4. The firearm magazine extension article of claim 3, wherein the extension spring stop comprises at least one magazine interface tab, which is received into the distal end of the OEM firearm magazine to align the extension spring stop to the OEM firearm magazine.

5. The firearm magazine extension article of claim 4, wherein the at least one magazine interface tab is located adjacent at least one of the securing grooves formed in the sidewalls of the extension body.

6. The firearm magazine extension article of claim 1, wherein the extension body surrounds the extension spring stop on at least three sides when the firearm magazine extension article is assembled.

7. The firearm magazine extension article of claim 1, wherein the OEM magazine tabs extend outwardly from the distal portion of the OEM firearm magazine; and wherein the securing grooves are formed in interior surfaces of the extension body and formed in an upper end portion of the extension body.

8. A firearm magazine extension article utilized in conjunction with a firearm magazine having outwardly-projecting magazine tabs, a magazine spring, and a spring plate, the firearm magazine extension article comprising:

an extension spring stop into which a lower end of the magazine spring extends to press the spring plate against the extension spring stop when the firearm magazine extension article is assembled onto the firearm magazine, the extension spring stop comprising:

an upper edge placed in abutment with a distal end of the firearm magazine when the firearm extension article is installed thereon; and at least a first magazine interface tab, which projects upwardly from the extension spring stop and which is received into the distal end of the firearm magazine to align the extension spring stop thereto; and an extension body configured to slidably engage the extension spring stop and the firearm magazine, the extension body comprising:

opposing sidewalls spaced laterally and receiving at least a portion of the extension spring stop therebetween when the firearm magazine extension article is assembled onto the firearm magazine; and securing grooves formed in the opposing sidewalls of the extension body, the securing grooves configured to receive the outwardly-projecting magazine tabs therein when the extension body is slid into engagement with the extension spring stop to attach the firearm magazine extension article to the distal end of the firearm magazine.

9. The firearm magazine extension article of claim 8, further comprising a spring plate tab projecting from the spring plate;

wherein the extension spring stop and the extension body comprise first and second receiving orifices, respectively; and wherein the first and second receiving orifices are brought into alignment to jointly receive the spring plate tab when the firearm magazine extension article is assembled onto the distal end of the firearm magazine.

10. The firearm magazine extension article of claim 8, wherein the first magazine interface tab is received into the distal end of the firearm magazine at a location laterally adjacent one of the outwardly-projecting magazine tabs.

11. The firearm magazine extension article of claim 8, wherein the extension body extends at least partially around the extension spring stop when the firearm magazine extension article is assembled onto the distal end of the firearm magazine.

* * * * *